US010994397B2

(12) United States Patent
Frock et al.

(10) Patent No.: US 10,994,397 B2
(45) Date of Patent: May 4, 2021

(54) TOOL TO INSERT FITTINGS INTO FLEXIBLE TUBING

(71) Applicants: Adam Frock, Larwill, IN (US); Richard Frock, Athens, PA (US)

(72) Inventors: Adam Frock, Larwill, IN (US); Richard Frock, Athens, PA (US)

( * ) Notice: Subject to any disclaimer, the term of this patent is extended or adjusted under 35 U.S.C. 154(b) by 539 days.

(21) Appl. No.: 15/849,820

(22) Filed: Dec. 21, 2017

(65) Prior Publication Data

US 2018/0178359 A1 Jun. 28, 2018

Related U.S. Application Data

(60) Provisional application No. 62/438,078, filed on Dec. 22, 2016.

(51) Int. Cl.
*B25B 27/10* (2006.01)

(52) U.S. Cl.
CPC ..... *B25B 27/10* (2013.01)

(58) Field of Classification Search
CPC .... B25B 7/02; B25B 7/18; B25B 7/20; B25B 7/22; B25B 9/00; B25B 9/04; B25B 25/00; B25B 25/005; B25B 27/0092; B25B 27/10; B25B 27/146; Y10T 29/53909; Y10T 29/53952; Y10T 29/53987; Y10T 29/53996; Y10T 29/53943; Y10T 29/53257; Y10T 29/537; A61F 2/95; B23P 11/005; A47J 43/26
USPC ..... 29/237, 259
See application file for complete search history.

(56) References Cited

U.S. PATENT DOCUMENTS

| | | | | |
|---|---|---|---|---|
| 3,599,310 A * | 8/1971 | Brownlee | B25B 25/005 29/237 |
| 5,979,032 A * | 11/1999 | Roy | B25B 27/10 29/237 |
| 7,665,718 B1 * | 2/2010 | Benson | B25B 27/10 269/237 |
| 2010/0170090 A1 * | 7/2010 | Rodrigues | H01R 43/04 29/861 |

* cited by examiner

*Primary Examiner* — Tyrone V Hall, Jr.
*Assistant Examiner* — Aaron R McConnell
(74) *Attorney, Agent, or Firm* — Brown & Michaels, PC

(57) ABSTRACT

A tool usable to insert tubing fittings into tubing includes a first handle and a second handle, each with a connection end and a gripping end. The connection end of the second handle is movably connected to the connection end of the first handle, the gripping end of the second handle being biased away from the gripping end of the first handle. A tube-gripping element is mounted on the first handle, and a fitting alignment fixture is mounted on the second handle. The tube-gripping element is configured to move into a first position to hold the tubing or into a second position to release the tubing, while the fitting alignment fixture is configured to press a protruding portion of the tubing fitting into an open end of the tubing.

19 Claims, 8 Drawing Sheets

TOOL TO INSERT FITTINGS INTO FLEXIBLE TUBING

REFERENCE TO RELATED APPLICATIONS

This application claims one or more inventions which were disclosed in Provisional Application No. 62/438,078, filed Dec. 22, 2016, entitled "Tool to Insert Barbed Fittings into Flexible Tubing". The benefit under 35 USC § 119(e) of the United States provisional application is hereby claimed, and the aforementioned application is hereby incorporated herein by reference in its entirety.

BACKGROUND OF THE INVENTION

The invention pertains to the field of tools, and more particularly, to a tool to insert fittings into tubing.

DESCRIPTION OF RELATED ART

Flexible tubing is used in a variety of applications, often to convey some sort of fluid. In industrial applications, for example, flexible tubing can be used to convey lubricants to machining equipment. In another example, flexible tubing can be used in pneumatics to carry and supply pressurized fluid. In the production of maple syrup, in yet another example, multiple tubes carrying sap from multiple taps in a single tree, or from multiple trees, are joined into a single tube, to create a network of tubes flowing sap from the trees to the central collection container. In each of these cases, and in a potentially limitless number of others, the tubing is fitted with end fittings, connection fittings, or other fittings that have a portion inserted into the tubing to attach nozzles or other end elements, to connect multiple sections of tubing, to connect tubing to a fluid source, etc. The connector fittings can be barbed to facilitate insertion and retention of the fittings inside the tubing. Various sorts of fittings can be used, such as but not limited to, connectors, plugs, valves, and nozzles.

The fittings are manually inserted, which can require a good deal of strength and dexterity. In some cases, stamina can also be taxed. For example, depending on the size of the maple syrup farm and the size of the collection tubing network, hundreds of fittings or more might be necessary to connect all the tubing. Installing this many fittings can tax and overwhelm the installer's strength, dexterity, and stamina, especially in colder weather.

SUMMARY OF THE INVENTION

A tool is disclosed herein to insert tubing fittings into the tubing, thereby lessening the strength and dexterity required, and generally improving the ease to connect flexible sap collection tubing with tubing fittings.

In an embodiment, a tool to insert tubing fittings into flexible tubing includes a first handle and a second handle, each with a connection end and a gripping end. The connection end of the second handle can be connected to the connection end of the first handle, and the gripping end of the second handle can be biased away from the gripping end of the first handle. A tube-gripping element can be mounted on the first handle, and can be configured to move into a first position to grip the tubing or into a second position to release the tubing. A fitting alignment fixture can be mounted on the second handle, and can be configured to align the fitting with the tubing when the tubing is gripped in the tube-gripping element.

In another embodiment, a tool to insert tubing fittings into tubing can include a first handle and a second handle, each with a connection end and a gripping end. The connection end of the second handle can be movably connected to the connection end of the first handle, the gripping end of the second handle being biased away from the gripping end of the first handle. A tube-gripping element can be mounted on the first handle, and a fitting alignment fixture can be mounted on the second handle. The tube-gripping element is configured to move into a first position to hold the tubing or into a second position to release the tubing, while the fitting alignment fixture is configured to press a protruding portion of the tubing fitting into an open end of the sap-collection tubing.

DETAILED DESCRIPTION OF THE INVENTION

Figure 1:
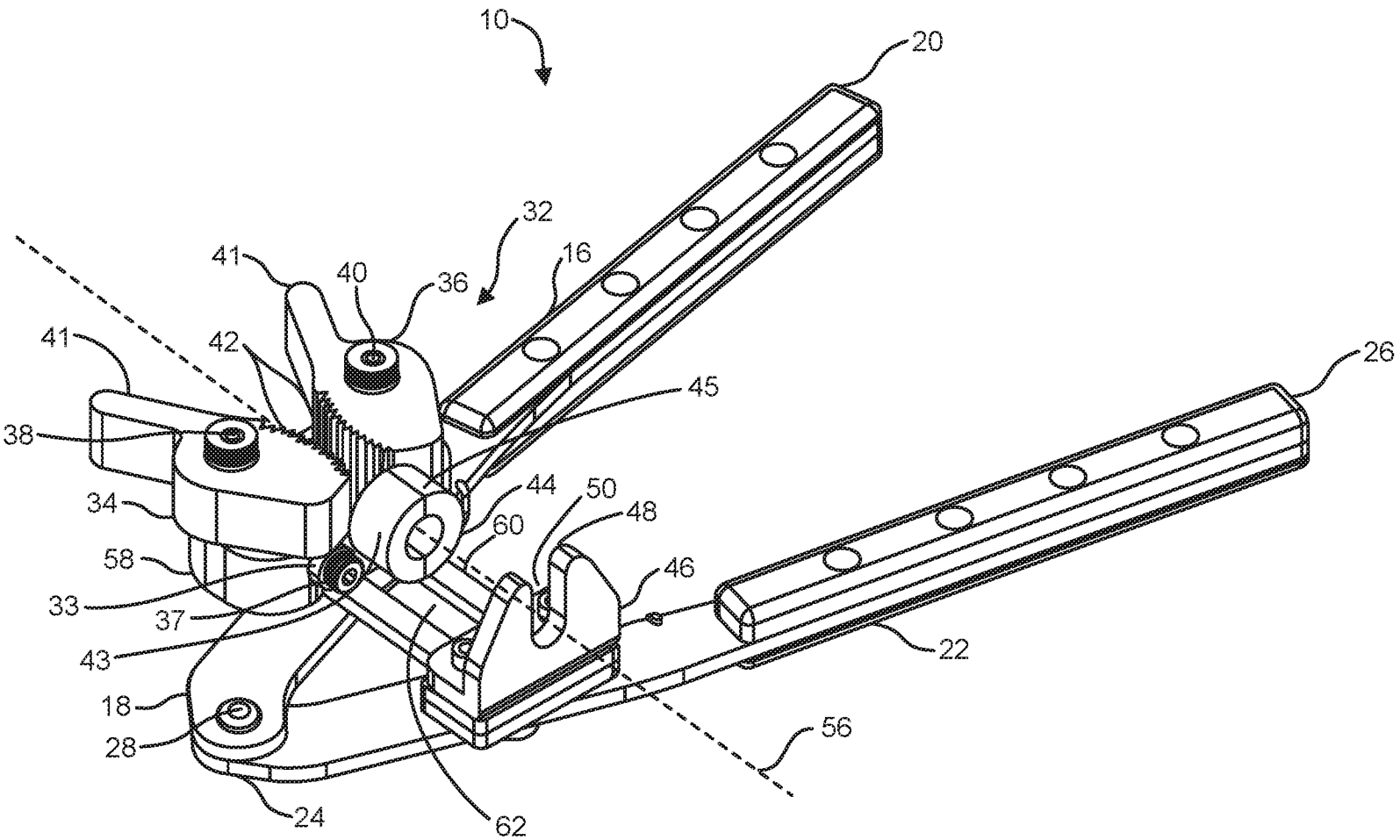
FIG. 1 shows a top isometric view of a tool to insert fittings into flexible tubing, according to an embodiment.

In the following description, reference is made to the accompanying drawings that form a part thereof, and in which is shown by way of illustration specific example embodiments in which the present teachings may be practiced. These embodiments are described in sufficient detail to enable those skilled in the art to practice the present teachings and it is to be understood that other embodiments may be utilized and that changes may be made without departing from the scope of the present teachings.

The terminology used herein is for the purpose of describing particular example embodiments only and is not intended to be limiting. As used herein, the singular forms "a", "an", and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to", "coupled to", or "mounted to" another element or layer, it may be directly on, engaged, connected, coupled, or mounted to the other element or layer, or intervening elements or layers may be present. In contrast, when an element is referred to as being "directly on," "directly engaged to", "directly connected to", "directly coupled to", or "directly mounted to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Spatially relative terms, such as "inner," "outer," "beneath", "below", "lower", "above", "upper" and the like, may be used herein for ease of description to describe one element's or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

As discussed above, manually installing tubing fittings to connect flexible sap collection tubing can be difficult, especially when connecting many tubes, or when doing so in cold weather. A tool is disclosed herein to insert tubing fittings into the tubing, thereby lessening the strength and dexterity required, and generally improving the ease to connect flexible sap collection tubing with tubing fittings.

FIGS. 1-4 illustrate a tool 10 to insert tubing fittings 12 into flexible tubing 14. The tube fitting 12 and the flexible tubing 14 can be easily positioned in the tool 10, and the tool can be easily operated to press the fitting 12 into the tubing 14 by hand squeezing. The tubing 14 is made of a flexible material, such as, but not limited to plastic, such that sufficient force of the fitting 12 into an open end of the tubing 14 can expand the tubing 14 to accept the fitting 12. The fitting 12 can be made of a hard material, such as but not limited to a hard plastic or metal, so that the fitting 12 can be pressed with sufficient force into the tubing 14. The fitting 12 can be barbed with a point smaller than the tube opening and a barb larger than the relaxed opening of the tubing 14, to facilitate insertion of the fitting 12 into the tubing 14 and retention of the fitting 12 in the tubing 14.

The tool 10 can include a first handle 16 with a connection end 18 and a gripping end 20. The tool 10 can also include a second handle 22 with a connection end 24 and a gripping end 26. The connection end 24 of the second handle 22 can be pivotably connected at a pivot joint 28 to the connection end 18 of the first handle 16, and the gripping end 26 of the second handle 22 can be biased away from the gripping end 20 of the first handle 16. A spring, such as torsion spring 30, or a compression spring, can be provided at the pivot joint 28 between the first handle 16 and the second handle 22 to create the bias. Other spring configurations, or now-known or future-developed biasing elements can alternatively be used to bias the gripping end 26 of the second handle 22 away from the gripping end 20 of the first handle 16. An operator can squeeze the first handle 16 and the second handle 22 toward each other, pivoting the handles 16, 22 around the pivot joint 28 to operate the tool 10.

A tube-gripping element 32 can be mounted on the first handle 16 to grip the tubing 14. The tube-gripping element 32 is configured to move into a first position to grip the tubing 14 and into a second position to release the tubing 14. While other embodiments capable of moving between a first position (for gripping) and a second position (for releasing) are conceived, the tube-gripping element 32 illustrated in FIGS. 1-4 includes a pair of tube-gripping cams 34, 36. To facilitate the movement between gripping and releasing positions, each tube-gripping cam 34, 36 can be pivotably mounted to the first handle 16 in any now-known or future-developed manner. In FIGS. 1-4, the tube-gripping cams 34, 36 pivot around respective pivot points defined by pivot pins 38, 40. A spring at each pivot pin 38, 40, or another now-known or future-developed biasing element, can bias the tube-gripping cams 34, 36 toward the gripping position. In FIGS. 1-4, the tube-gripping cams 34, 36 contain internal torsion springs at the pivot points 38, 40.

In the gripping position, the tube-gripping element 32 engages with the tubing 14 with enough force to hold the tubing 14 without slippage while pressing the tubing fitting 12 into the tubing 14, but gentle enough to enable a normal human operator to manually squeeze a lever portion 41 of each tube-gripping cam 34, 36 and make the tube-gripping cams pivot from the gripping position to the releasing position. The tube-gripping cams 34, 36 can each have a gripping surface 42, such as but not limited to knurling, ridges, a roughened surface, a frictional coating, or teeth. In the embodiment illustrate in the figures, the gripping surface 42 includes teeth, which can be angled toward the fitting fixture 12 to facilitate gripping of the tubing 14, and to prevent slippage of the tubing 14 when the tube-gripping cams 34, 36 are in the first position. Other variations of tube-gripping elements can also have teeth or other characteristics described with respect to the tube-gripping cams 34, 36.

Figure 8:
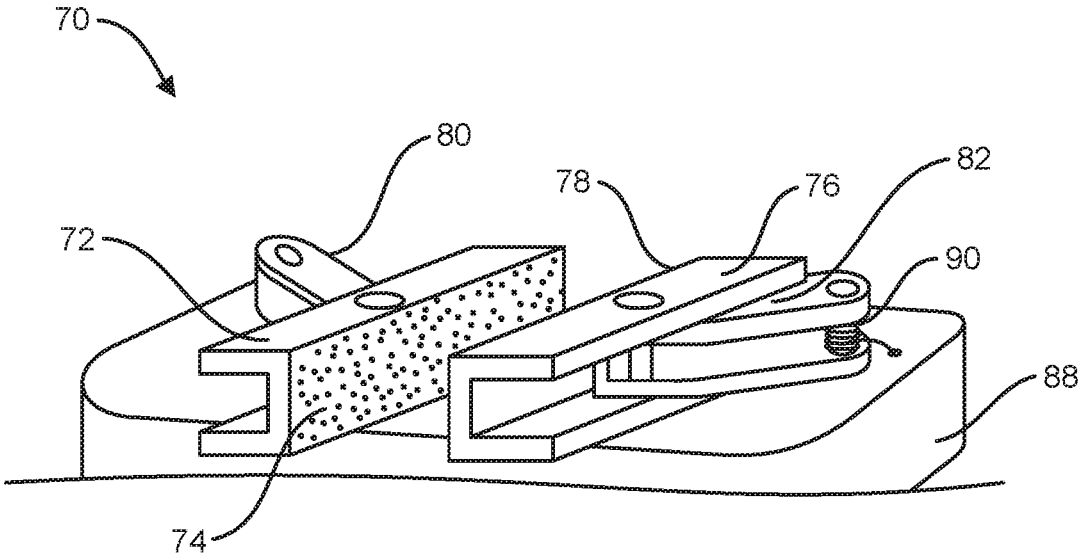
FIG. 8 shows an isometric view of a tube-gripping element, according to an embodiment of the tool.
Figure 9:
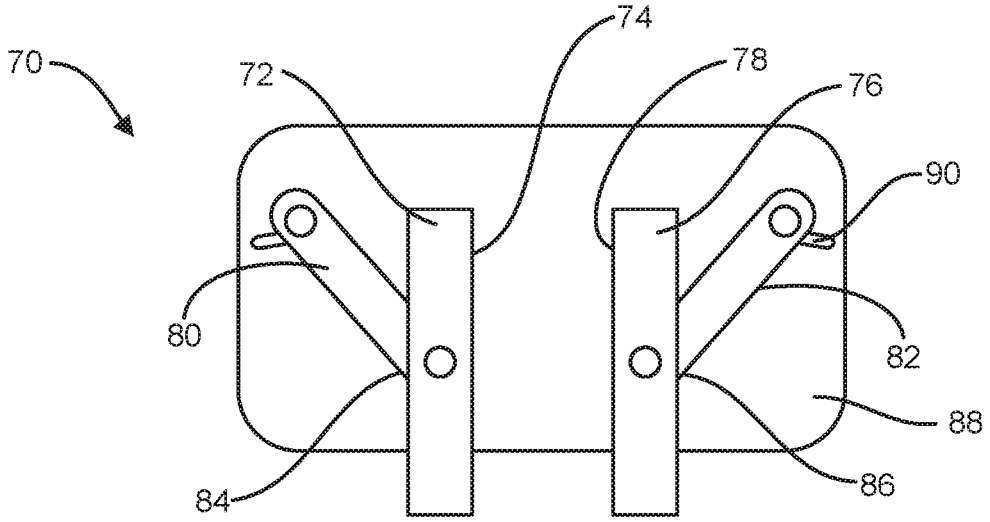
FIG. 9 shows a top view of the tube-gripping element of FIG. 8.

FIG. 8 and FIG. 9 illustrate an alternative tube-gripping element 70, which can include a first gripper 72 having a gripping surface 74, and a second gripper 76 having a gripping surface 78. The grippers 72, 76 can be connected (or directly connected) to swing arms 80, 82 at a respective end 84, 86 of the swing arms 80, 82. At a distance from the respective gripper 72, 76, the respective swing arm 80, 82, can be pivotably connected (or directly connected) to a base element 88, which can be, but is not limited to, the first handle 16 or a cam plate 58 (which is further described below). The swing arms 80, 82 can be biased to move the grippers 72, 76 toward each other to grip the tubing 14, such as with a torsion spring 90. The gripping surface shown in FIG. 8 is a textured surface, though any now-known or future-developed gripping surface is conceived.

Figure 4:
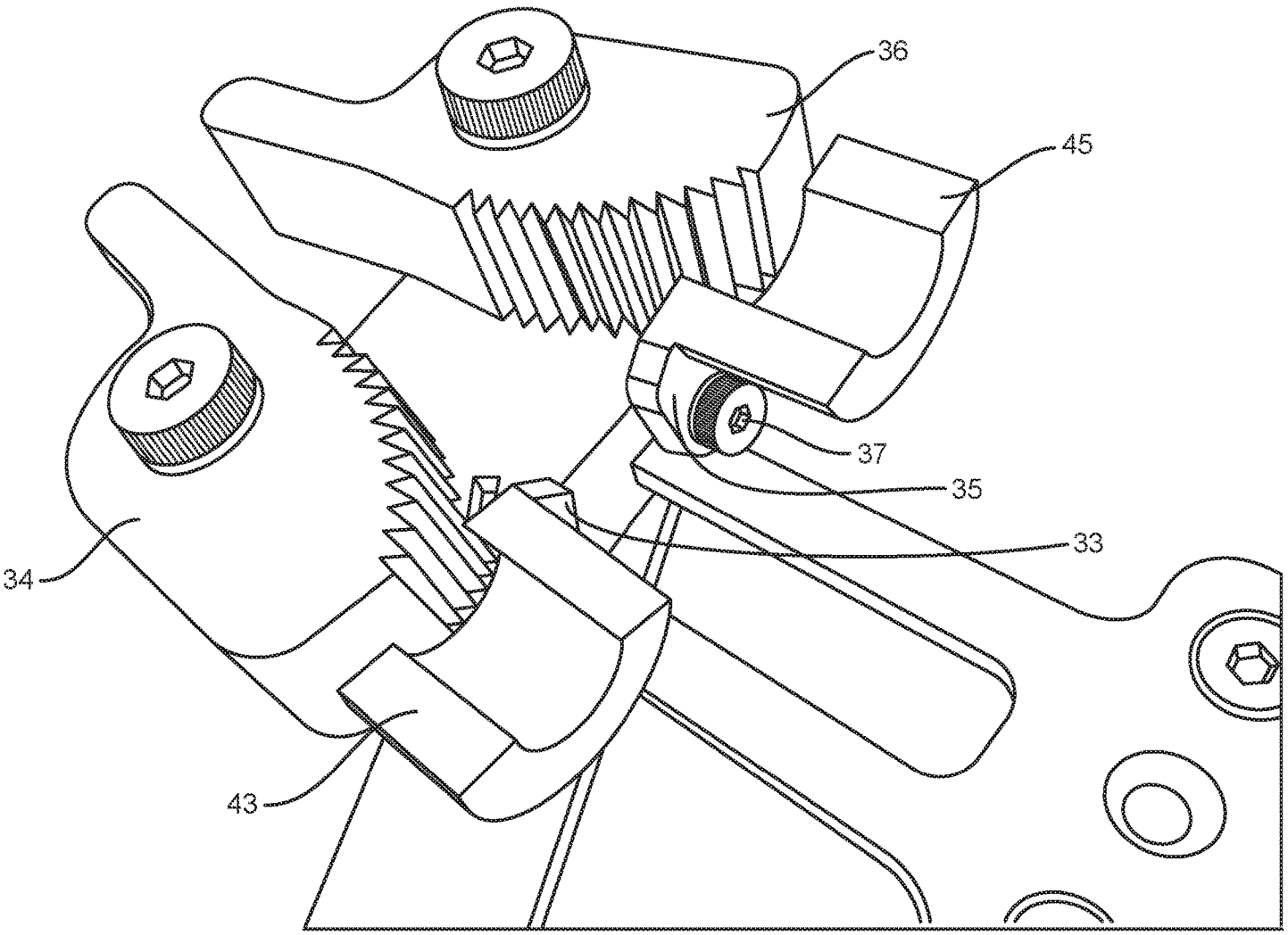
FIG. 4 shows a top isometric view of a tube-gripping element and alignment guide, according to the embodiment of FIG. 1.

A tubing alignment guide 44 can be mounted on the first handle 16 to guide the tubing 14 into alignment, and to hold the end of the tubing 14 in place and prevent deflection when pressing a tubing fitting 12 into the tubing 14. The tubing alignment guide 44 can include a first alignment element 43 and a second alignment element 45, each semicircular or semi-annular, such that together they can form a circular or annular shape encircling a section of the tube. The first and second alignment elements 43, 45 can be mounted and configured to move apart and close together, or rotate apart and together, such as with actuation of the tube-gripping cams 34, 36, in order to facilitate placement of the tubing in and removal of the tubing from the tool 10. For example, as illustrated in FIGS. 1 and 4, an arm 33 of the first alignment element 43 can be pivotably secured by a bolt 37 to a cam plate 58, which can be mounted between the tube-gripping cams 34, 36 and the first handle 16. The first alignment element 43 can pivot around the bolt 37 to move between an open and a closed position. The tube-gripping cam 36 can include a symmetrical arm 35. In the closed position, the tube-gripping cams 34, 36 can extend over the respective arm 33, 35, locking the arms 33, 35 from moving to an open position.

Opposing the tube-gripping element 32, a fitting alignment fixture 46 can be mounted on the second handle 22 to hold the tubing fitting 12 during use of the tool 10. The fitting alignment fixture 46 is configured to align the fitting 12 with the tubing 14 when the tubing 14 is gripped in the tube-gripping element 32. In the embodiment of FIGS. 1-4, the fitting alignment fixture 46 includes a back plate 48 to press the fitting 12 into the tubing 14 during operation of the tool 10. The back plate can include a slot 50 extending perpendicularly to the second handle 22. The slot 50 is configured to accept a first prong 52 or other protrusion of the fitting 12 extending oppositely from a second prong 54 oriented to be inserted into the tubing 14. The fitting alignment fixture 46 is modular such that the fitting alignment fixture 46 can be easily removed and replaced with an alternative fitting alignment fixture sized differently to accommodate differently sized fittings, or shaped differently to accommodate differently shaped fittings.

During use, the fitting alignment fixture 46 and the tube-gripping element 32 can move toward and away from each other, with movement of the handles 16, 22, along an arc defined by the pivot joint 28 and the distance of the tube-gripping element 32 and the fixture fitting 46 from the pivot joint 28. Alternatively, as is shown in FIGS. 1-4, the tube-gripping element 32 and fitting alignment fixture 46 can be locked in alignment on a center axis 56. In this latter case, the tube-gripping element 32 can be pivotable on the first handle 16, and the fitting alignment fixture 46 can be pivotable on the second handle 22, such that when the handles 16, 22 are moved toward or away from each other, the tube-gripping element 32 and the fitting alignment fixture 46 can each pivot relative to its respective handle 16, 22 to retain orientation relative to the other of the tube-gripping element 32 and the fitting alignment fixture 46.

To achieve pivotable mounting, the fitting alignment fixture 46 can be mounted (or directly mounted) to the second handle 22 by a single pivotable mounting element, such as, but not limited, to a pin or bolt 47. At least in part because the tube-gripping element 32 can have multiple moving components that would need to pivot in unison to retain alignment of the tube-gripping element 32 with the fitting alignment fixture 46, the tube-gripping element 32 can be mounted (or directly mounted) on a cam plate 58. The cam plate 58 can be mounted (or directly mounted) on the first handle 16 by a single pivotable mounting element, such as, but not limited, to a pin or bolt 49. The tube-gripping element 32 can be mounted (or directly mounted) on the cam plate 58. In the case of the illustrated embodiment, the tube-gripping element 32—in this case a pair of tube-gripping cams 34, 36—is pivotable on the first handle 16, and the fitting alignment fixture 46 is pivotable on the second handle 22.

To lock the orientation and alignment of the fitting alignment fixture 46 and the tube-gripping element 32 with respect to each other, a spanning element 60 can extend from the fitting alignment fixture 46 to the tube-gripping element 32. The spanning element 60 can be configured variously to achieve the effect of locking the orientation and alignment of the fitting alignment fixture 46 and the tube-gripping element 32 with respect to each other. According to an embodiment, the spanning element 60 can be pivotably mounted to one of the first handle 16 at the tube-gripping element 32 and the second handle 22 at the fitting alignment fixture 46, such that the one of the tube-gripping element 32 and the fitting alignment fixture 46 can be non-pivotably mounted to the spanning element 60. The spanning element 60 can be non-pivotable relative to the tube-gripping element 32 as a whole and the fitting alignment fixture 46. The spanning element 60 can be slidable along the axis 56 relative to the tube-gripping element 32 and the fitting alignment fixture 46.

Figure 2:
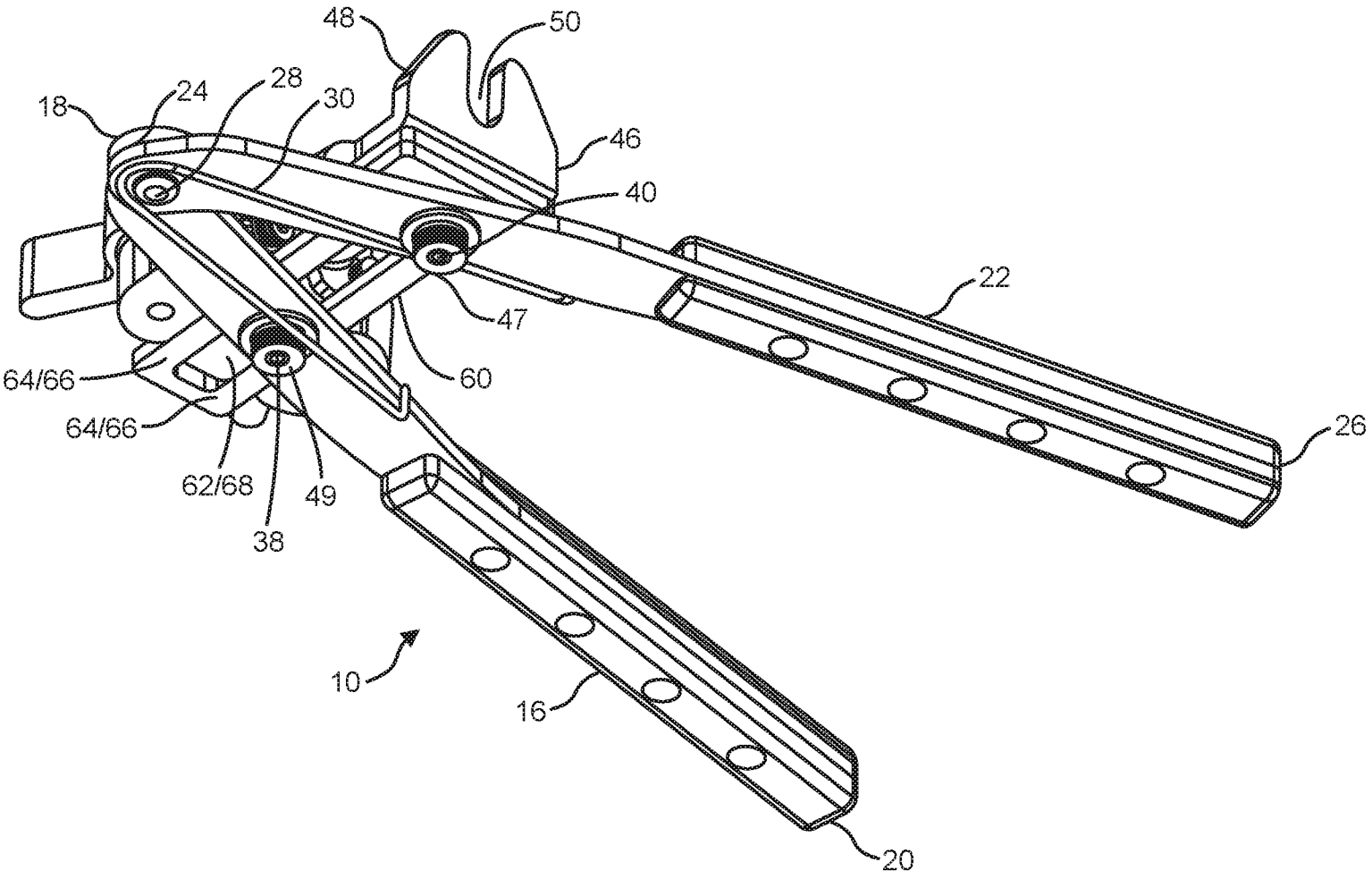
FIG. 2 shows a bottom isometric view of the tool of FIG. 1.

In FIGS. 1-2, the spanning element 60 is pivotably mounted (or mounted directly) to the second handle 22, and the fitting alignment fixture 46 is mounted (or mounted directly) to the spanning element 60, such that the spanning element 60 and the fitting alignment fixture 46 pivot in unison with respect to the second handle 22. The spanning element 60 includes a slot 62 running along the axis 56. The slot 62 is defined by two rails 64. The tube-gripping element 32 is configured with two channels 66 to receive the rails 64, and/or an elongated pin 68 to project into the slot 62. The rails 64 and channels 66, and/or the slot 62 and elongated pin 68 rotationally lock the spanning element 60 with the tube-gripping element 32, while allowing the spanning element 60 to slide relative to the first handle 16 and the tube-gripping element 32, such that the first handle 16 can move toward and away from the second handle 22. In other words, the spanning element 60 and the tube-gripping element 32 cannot rotate with respect to each other, but can slide relative to each other in a linear direction along the axis 56.

As discussed above, the spanning element 60 can be configured variously to achieve the effect of locking the orientation and alignment of the fitting alignment fixture 46 and the tube-gripping element 32 with respect to each other. Some of these embodiments utilize a rod, dovetail, T-Slot, connecting linkages, or other alignment elements capable of maintaining the parallel alignment between the fitting alignment fixture 46 and the cam plate 58 and/or tube-gripping element 32.

Figure 3:
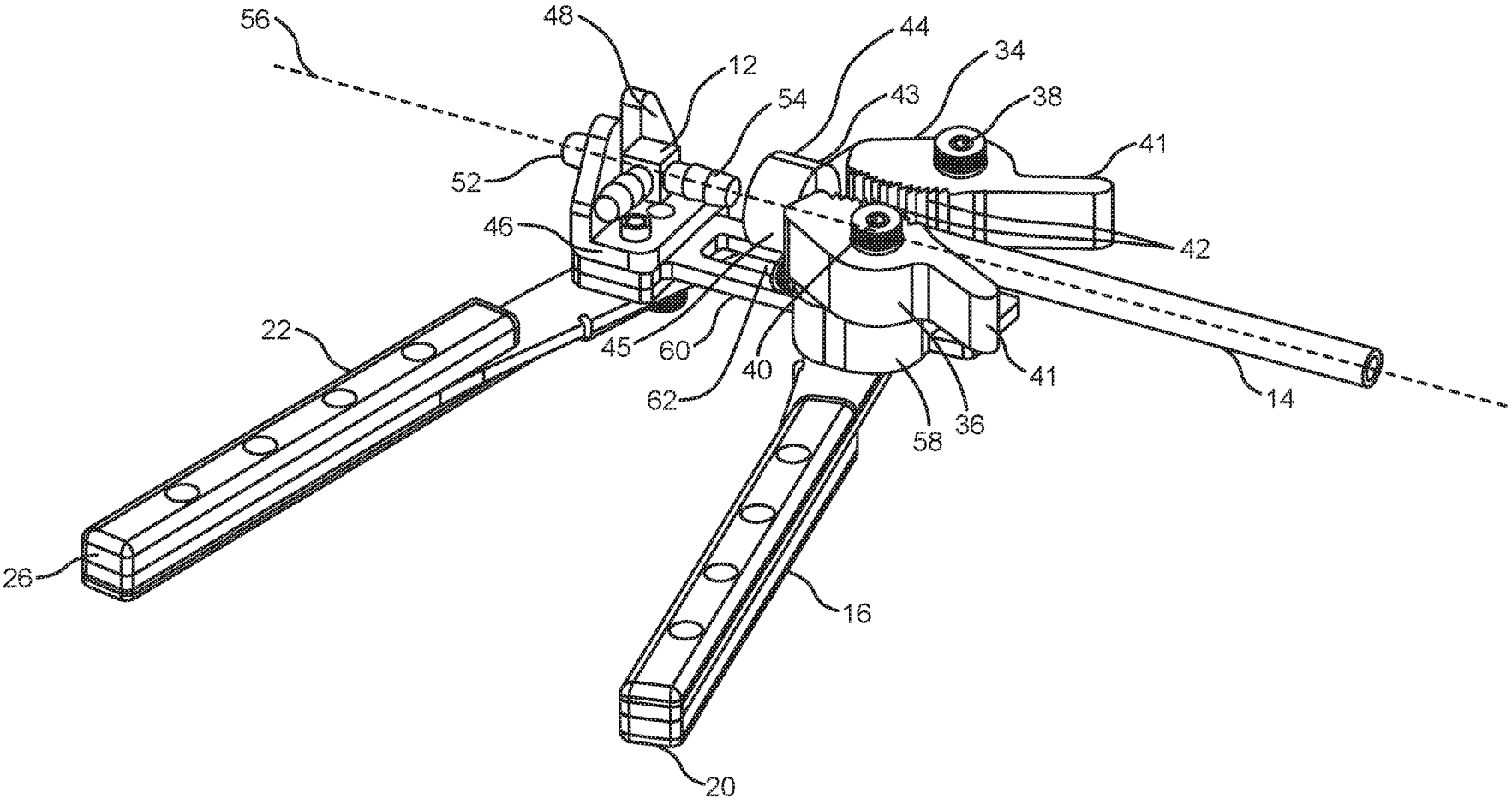
FIG. 3 shows a top isometric view of the tool of FIG. 1 with a flexible tube and a tube fitting.

Operation of the tool 10 is described with respect to the embodiment of FIGS. 1-4, though such description is not intended to be limiting. It is expected that operation of the tool 10, in view of the following description, can be applied and modified as necessary to match various alternative embodiments discussed above. To operate the tool 10, a length of flexible tubing 14 and a tube fitting 12 are placed into the tool 10. In the embodiment of FIGS. 1-4, placing the flexible tubing 14 into the tool 10 includes positioning the tubing 14 between the tube-gripping cams 34, 36 and through the tubing alignment guide 44, as shown in FIG. 3. The lever portions 41 of the tube-gripping cams 34, 36 can be squeezed together to allow room to position the tubing 14 between the tube-gripping cams 34, 36. Squeezing the lever portions 41 of the tube-gripping cams 34, 36 toward each other also unlocks the tubing alignment guide 44 so that the first alignment element 43 and the second alignment element 45 can be separated. The tubing 14 is inserted until the end of the tubing 14 slightly protrudes from the tubing alignment guide 44. The tubing alignment guide 44 can be closed around the tubing 14, and the lever portions 41 of the tube-gripping cams 34, 36 can be released to allow the tube-gripping cams 34, 36 to clamp onto the tubing 14, which also positions the tube-gripping cams 34, 36 over the arms 33, 35 to lock the tubing alignment guide 44 in the closed position.

Also in the embodiment of FIGS. 1-4, placing the tube fitting 12 in the tool 10 includes positioning the tube fitting 12 with the first prong 52 or other protrusion through the slot 50 and the second prong 54 extending opposite the first prong 52, such that the second prong 54 extends directly toward the flexible tubing in approximate axial alignment.

Figure 5:
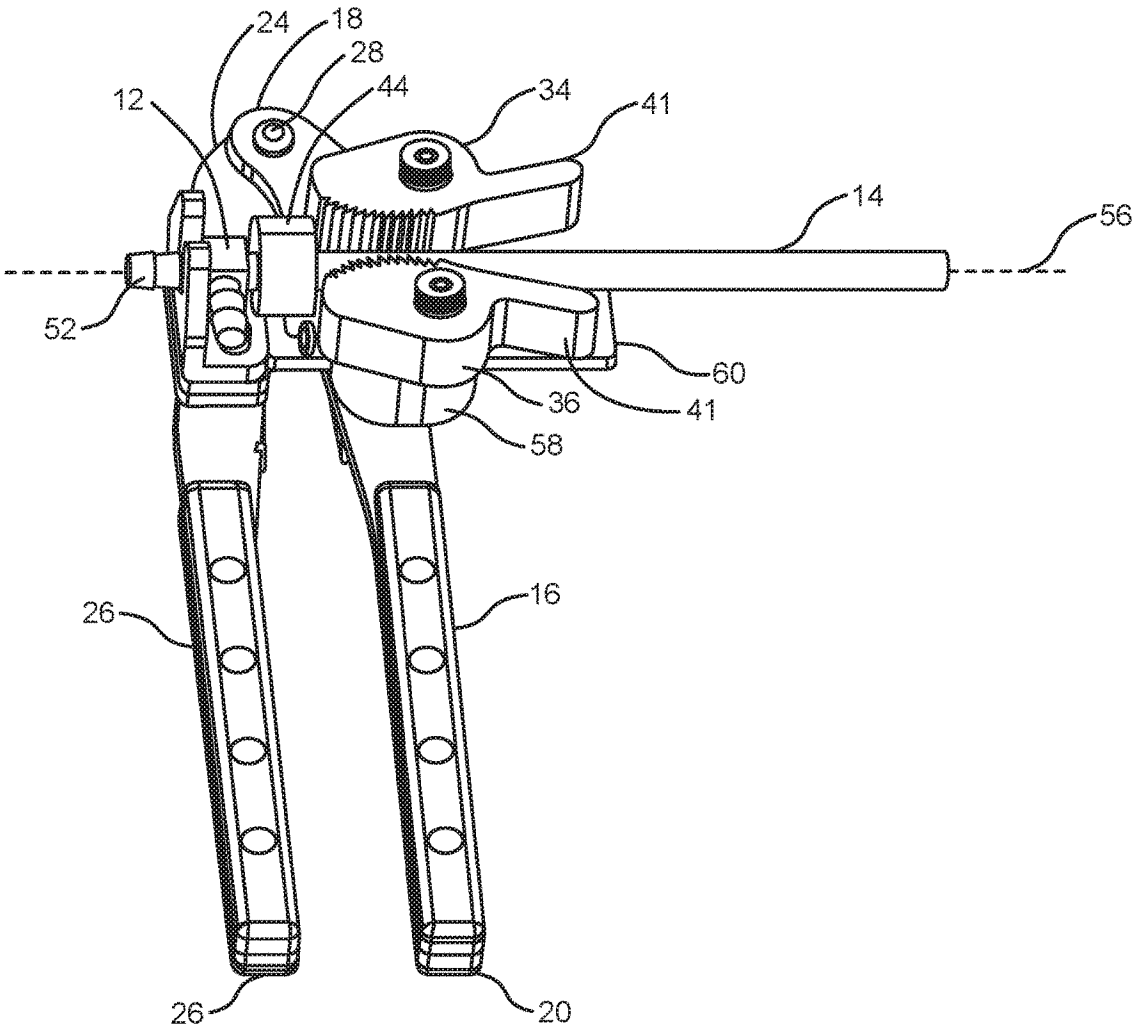
FIG. 5 shows a top isometric view of the tool of FIG. 1 with handles squeezed together to press a tube fitting into a flexible tube.

Referring to FIG. 5, the first handle 16 and the second handle 22 can be squeezed together at the gripping ends 20, 26 such that the second prong 54 of the tube fitting 12 is pressed into the tubing 14 until the tube fitting 12 is fully seated into the flexible tubing 14.

Figure 6:
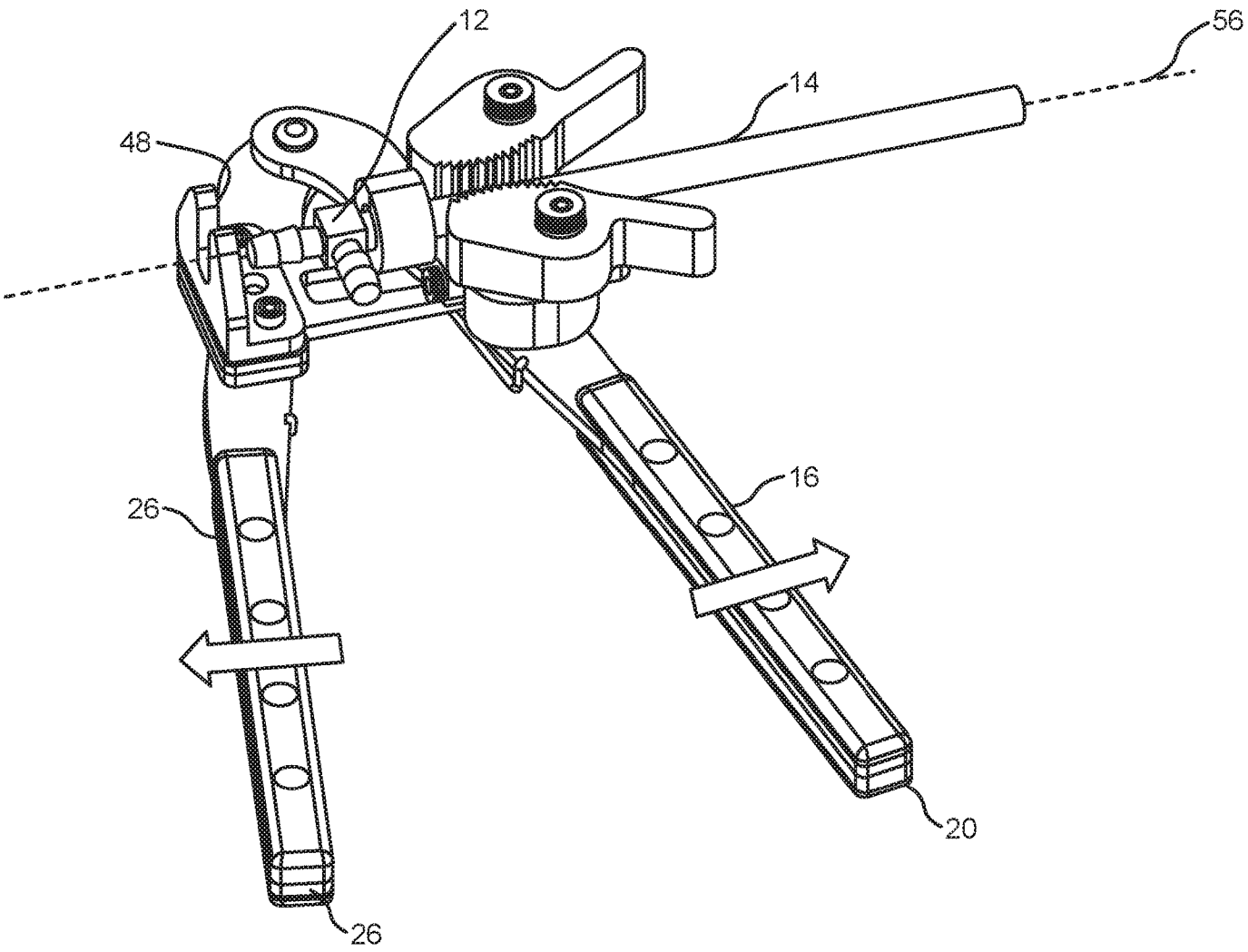
FIG. 6 shows a top isometric view of the tool of FIG. 1 with handles released after pressing a tube fitting into a flexible tube.

Referring to FIG. 6, the handles 16, 22 can be released, allowing the spring 30 to spread the handles 16, 22, which relieves pressure of the back plate 48 on the tube fitting 12 toward the tubing 14.

Figure 7:
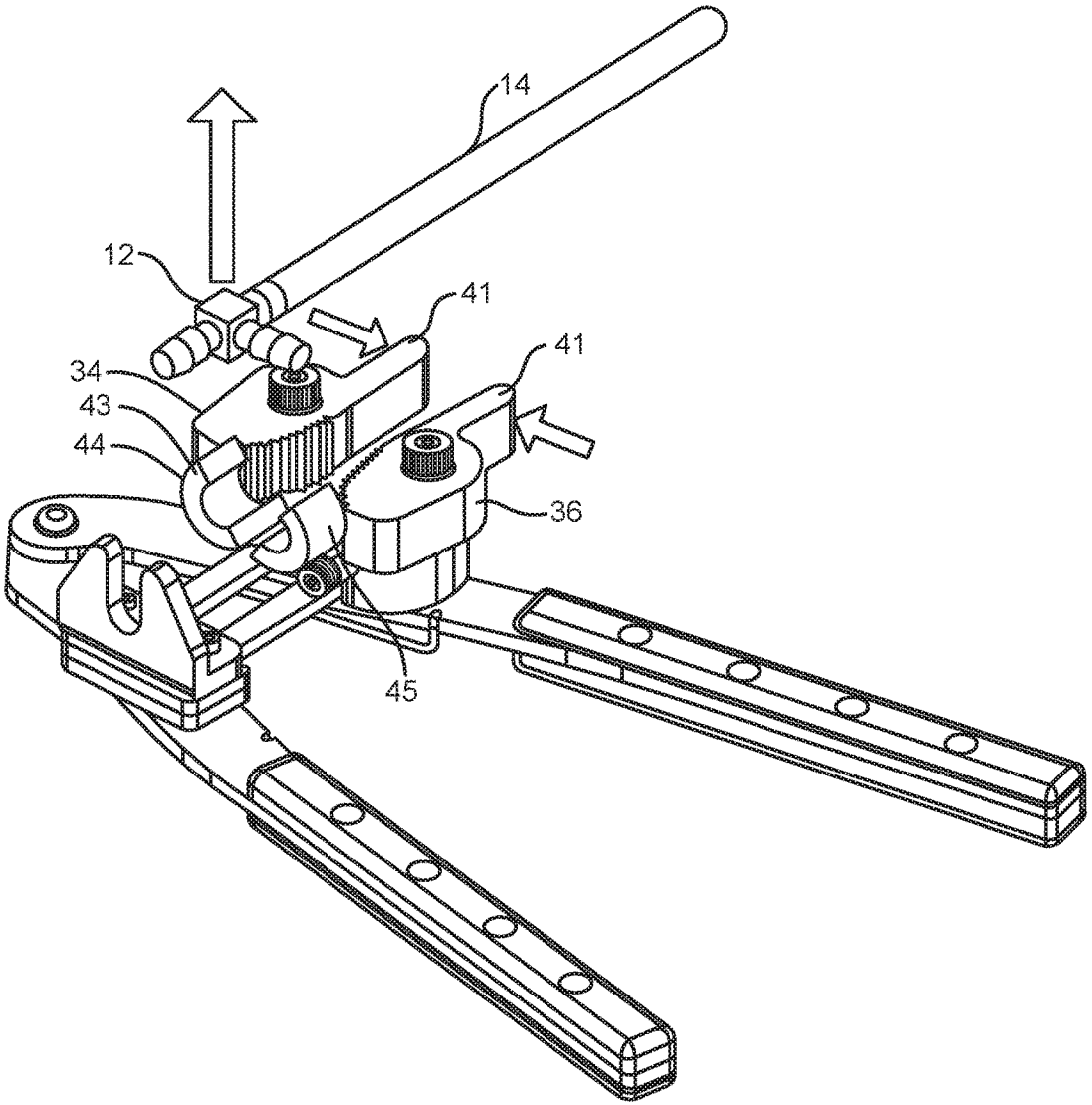
FIG. 7 shows a top isometric view of the tool of FIG. 1 with lever portions of tube-gripping cams squeezed together to release flexible tubing and tube fitting.

Referring to FIG. 7, the lever portions 41 of tube-gripping cams 34, 36 can be squeezed together to release the flexible tubing 14 and the connected tube fitting 12. Squeezing the lever portions 41 of the tube-gripping cams 34, 36 toward each other also unlocks the first and second alignment elements such that they can be separated. As a result, the flexible tubing 14 with assembled fitting 12 can be removed unobstructed.

Releasing the lever portions 41 of the gripping cams 34, 36 returns the tool 10 to an initial state, as shown in FIGS. 1-2.

As discussed above, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A tool usable to insert tubing fittings into flexible tubing, the tool comprising: a first handle with a connection end and a gripping end; a second handle with a connection end and a gripping end, the connection end of the second handle connected to the connection end of the first handle, the gripping end of the second handle biased away from the gripping end of the first handle; a tube-gripping element mounted on the first handle, the tube-gripping element positioned between the connection end and gripping end of the first handle, the tube-gripping element configured to move into a first position to grip the tubing and into a second position to release the tubing; a fitting alignment fixture mounted on the second handle, the fitting alignment fixture positioned between the connection end and gripping end of the second handle, the fitting alignment fixture configured to align the fitting with the tubing when the tubing is gripped in the tube-gripping element; a tubing alignment guide mounted on the first handle and configured to guide the tubing into alignment on an axis of the tube-gripping element and the fitting alignment fixture, the tubing alignment guide having a first alignment element and a second alignment element configured to move toward and apart from each other.

2. The tool according to claim 1, wherein the connection end of the second handle is pivotably connected to the connection end of the first handle.

3. The tool according to claim 1, wherein the tube gripping element includes a pair of tube-gripping cams.

4. The tool according to claim 3, wherein each gripping cam includes a pivot point about which the respective gripping cam rotates.

5. The tool according to claim 3, wherein the gripping cams each have a gripping surface to facilitate gripping of the tubing when the cams are in the first position.

6. The tool according to claim 5, wherein the gripping surface includes teeth angled toward the fitting alignment fixture.

7. The tool according to claim 1, wherein the tube-gripping element is biased toward the first position.

8. The tool according to claim 1, wherein the fitting alignment fixture includes a back plate to press the fitting into the tubing during operation of the tool.

9. The tool according to claim 8, wherein the back plate includes a slot extending perpendicularly to the second handle and configured to accept a prong of the fitting.

10. The tool according to claim 1, wherein the tube-gripping element is pivotable on the first handle.

11. The tool according to claim 10, wherein the tool further comprises a cam plate pivotably mounted to the first handle, the tube-gripping element being mounted to the cam plate.

12. The tool according to claim 1, wherein the fitting alignment fixture is pivotable on the second handle.

13. The tool according to claim 1, wherein the tube-griping element is pivotable on the first handle, the fitting alignment fixture is pivotable on the second handle, and the tool further comprises a spanning element extending from the fitting alignment fixture to the tube-gripping element and configured to lock the fitting alignment fixture in alignment with the tube-gripping element.

14. The tool according to claim 13, wherein the spanning element is pivotably mounted to one of the first handle at the tube-gripping element and the second handle at the fitting alignment fixture, is non-pivotable relative to the tube-gripping element and the fitting alignment fixture, and is slidable along an axis of the tube-gripping element and the fitting alignment fixture relative to one of the tube-gripping element and the fitting alignment fixture.

15. A tool to insert tubing fittings into tubing, the tool comprising: a first handle with a connection end and a gripping end; a second handle with a connection end and a gripping end, the connection end of the second handle movably connected to the connection end of the first handle, the gripping end of the second handle biased away from the gripping end of the first handle; a tube-gripping element mounted on the first handle, the tube-gripping element positioned between the connection end and gripping end of the first handle, the tube-gripping element configured to move into a first position to hold the tubing or into a second position to release the tubing, the tube-gripping element biased toward the first position; a fitting alignment fixture mounted on the second handle, the fitting alignment fixture positioned between the connection end and gripping end of the second handle, the fitting alignment fixture configured to press a protruding portion of the tubing fitting into an open end of the tubing.

16. A tool usable to insert a fitting into a tubing, the tool comprising:

first and second elongated members rotatingly connected at first ends thereof;

a tube-gripping element fastened to one of the first and second elongated members and including first and second cams each having teeth facing the teeth of the other cam and configured to rotate with respect to each other in a first direction to grip the tubing and in a second direction to release the tubing; and a fitting alignment fixture fastened to the other one of the first and second elongated members and including a groove to receive and align the fitting with the gripped tubing such that when second ends of the first and second elongated members are rotated toward each other the fitting is pressingly fit into the tubing;

a spanning element including a groove extending therethrough between a first end and a second end, the spanning element being connected at the first end to one of the first and second elongated members and the fitting alignment fixture and slidingly connected at the second end to the other one of the first and second elongated members and the tube gripping element through the groove, the spanning element being pivotable at at least one of the connections at the first end and the second end, such that the spanning element aligns the tube-gripping element and the fitting alignment fixture when the first and second elongated members are rotated together.

17. The tool of claim 16, further comprising:

a biasing member disposed at the first ends of the first and second elongated members to bias the second ends of the elongated members away from each other.

18. The tool according to claim 15, wherein the tube gripping element includes a pair of tube-gripping cams each including a lever portion to facilitate manual movement of the tube gripping cams into the second position.

19. The tool according to claim 11, wherein the first alignment element and the second alignment element are pivotably connected to the cam plate and configured such that when the tube gripping element is in the first position the first alignment element and the second alignment element are pressed together to hold the tubing in alignment.

* * * * *